US007329210B1

(12) United States Patent
Marano

(10) Patent No.: US 7,329,210 B1
(45) Date of Patent: Feb. 12, 2008

(54) VERTICAL TRAINING APPARATUS

(76) Inventor: Vincenzo Marano, 175 Vern La., Cheektowaga, NY (US) 14227

( * ) Notice: Subject to any disclaimer, the term of this patent is extended or adjusted under 35 U.S.C. 154(b) by 346 days.

(21) Appl. No.: 10/909,867

(22) Filed: Aug. 2, 2004

(51) Int. Cl.
*A63B 69/34* (2006.01)

(52) U.S. Cl. ..... 482/83

(58) Field of Classification Search ..... 482/83–90, 482/62; D21/787, 665, 662, 722, 798; 2/18; D29/116.1
See application file for complete search history.

(56) References Cited

U.S. PATENT DOCUMENTS

| | | | | | |
|---|---|---|---|---|---|
| 825,860 | A | * | 7/1906 | McKenzie | 482/90 |
| 5,046,724 | A | | 9/1991 | Sotomayer | |
| 5,256,069 | A | * | 10/1993 | Snowden et al. | 434/247 |
| 5,352,170 | A | * | 10/1994 | Condo et al. | 482/83 |
| D356,127 | S | | 3/1995 | Mara | |
| 5,700,230 | A | | 12/1997 | Cardona | |
| 5,722,920 | A | * | 3/1998 | Bauer | 482/83 |
| 5,735,775 | A | * | 4/1998 | Miasserian | 482/83 |
| 6,033,348 | A | | 3/2000 | Warshauer | |
| 6,155,960 | A | | 12/2000 | Roberts et al. | |
| D437,908 | S | * | 2/2001 | Hsiung et al. | D21/787 |
| 6,241,640 | B1 | | 6/2001 | Chu | |
| 6,280,351 | B1 | * | 8/2001 | Wong | 473/422 |
| 6,432,027 | B1 | * | 8/2002 | Haselrig | 482/83 |
| 6,494,820 | B2 | * | 12/2002 | Orlando | 482/148 |
| 6,872,171 | B2 | * | 3/2005 | Haselrig | 482/83 |
| 7,086,997 | B1 | * | 8/2006 | Fields et al. | 482/90 |
| 2003/0073548 | A1 | * | 4/2003 | Haselrig | 482/83 |

* cited by examiner

*Primary Examiner*—Lori Amerson

(57) ABSTRACT

A vertical training apparatus for allowing a user to practice striking and combinations of strikes against an opponent. The vertical training apparatus includes a stanchion member being designed for being coupled to a support surface whereby the stanchion member extends upwardly from the support surface. A plurality of target assemblies are adjustably coupled to the stanchion member. Each of the target assemblies is designed for being struck by the user to practice strikes. One of the target assemblies is designed for representing an upper torso of an opponent to allow the user to practice strikes against the upper torso of the opponent, the other of the target assemblies is designed for representing a lower torso of the opponent to allow the user to practice strikes against the lower torso of the opponent.

18 Claims, 12 Drawing Sheets

VERTICAL TRAINING APPARATUS

BACKGROUND OF THE INVENTION

1. Field of the Invention

The present invention relates to martial arts practice devices and more particularly pertains to a new vertical training apparatus for allowing a user to practice striking and combinations of strikes against an opponent.

2. Description of the Prior Art

The use of martial arts practice devices is known in the prior art. U.S. Pat. No. 5,722,920 describes a device for providing a plurality of target members to be struck by a user to practice martial arts. Another type of martial arts practice device is U.S. Pat. No. 5,700,230 having a moveable mannequin that can be positioned to mimic certain positions of a human to allow a user to practice martial arts against the mannequin. U.S. Pat. No. 6,033,348 has a striking member that is coupled to a biasing member that is mounted to a support structure with the striking member being struck by a user and the biasing member providing resistance to the strike. U.S. Pat. No. 6,155,960 has a dummy that resembles the structure of a human and is capable of being posed to allow a user to train in martial arts. U.S. Pat. No. 5,046,724 has a device for allowing two facing boxers to practice strikes by allowing the device to react to a strike of one of the boxers and allowing the other box to react to the reaction of the device. U.S. Pat. No. Des. 356,127 shows a martial arts practice stand.

While these devices fulfill their respective, particular objectives and requirements, the need remains for a device that has certain improved features allows a user to selective practice different strikes against different target areas.

SUMMARY OF THE INVENTION

The present invention meets the needs presented above by providing a plurality of strike targets coupled to each of the target assemblies with the target assemblies be adjustable to allow the strike targets to be selectively positioned to allow the user to practice a variety of strikes at the same time.

Still yet another object of the present invention is to provide a new vertical training apparatus that allows a user to get exercise.

Even still another object of the present invention is to provide a new vertical training apparatus that allows a boxer to practice combinations of strikes to be used against an opponent in the boxing ring.

To this end, the present invention generally comprises a stanchion member being designed for being coupled to a support surface whereby the stanchion member extends upwardly from the support surface. A plurality of target assemblies are adjustably coupled to the stanchion member. Each of the target assemblies is designed for being struck by the user to practice strikes. One of the target assemblies is designed for representing an upper torso of an opponent to allow the user to practice strikes against the upper torso of the opponent, the other of the target assemblies is designed for representing a lower torso of the opponent to allow the user to practice strikes against the lower torso of the opponent.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
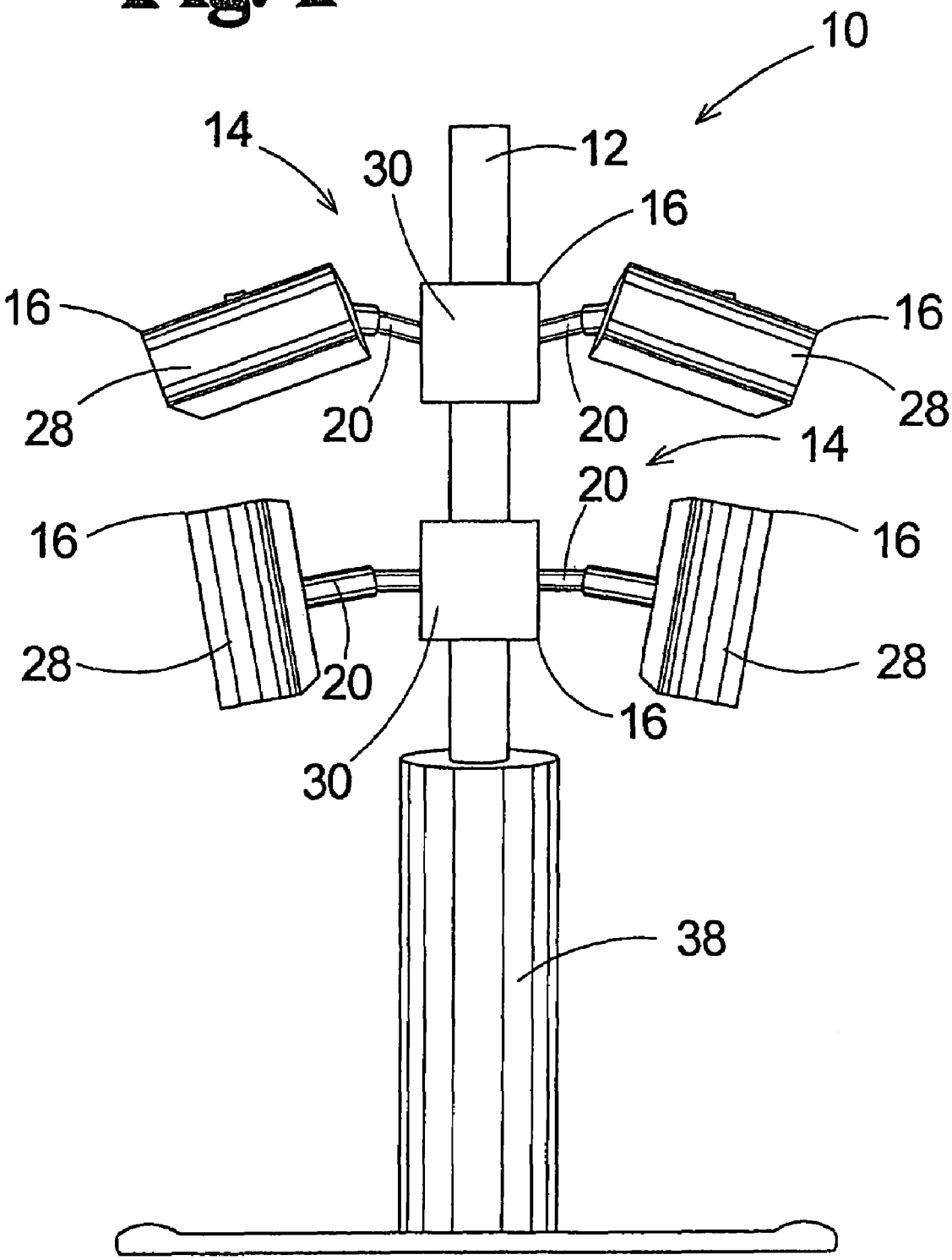
FIG. 1 is a front view of a new vertical training apparatus according to the present invention.
Figure 2:
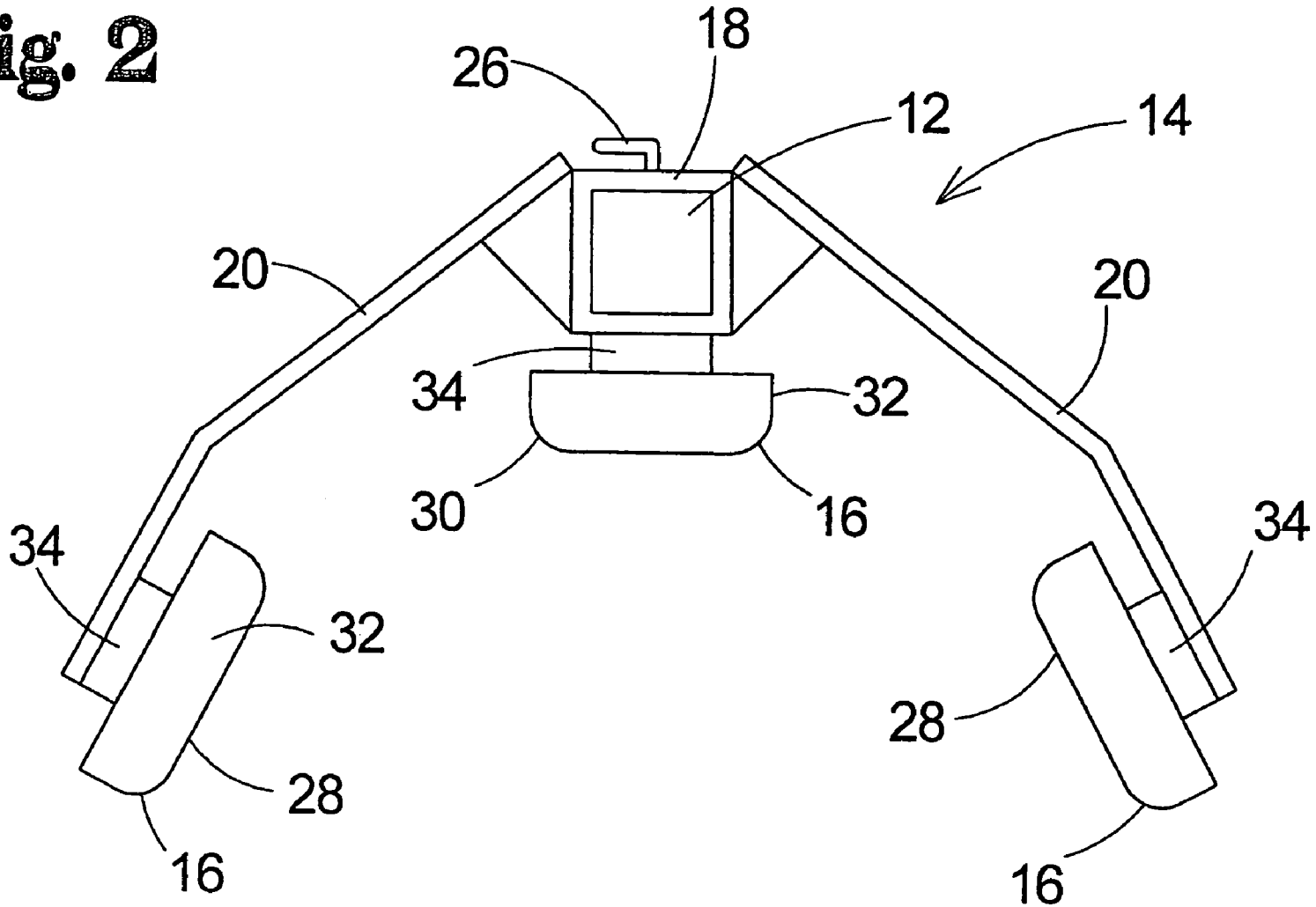
FIG. 2 is a top view of the present invention.
Figure 3:
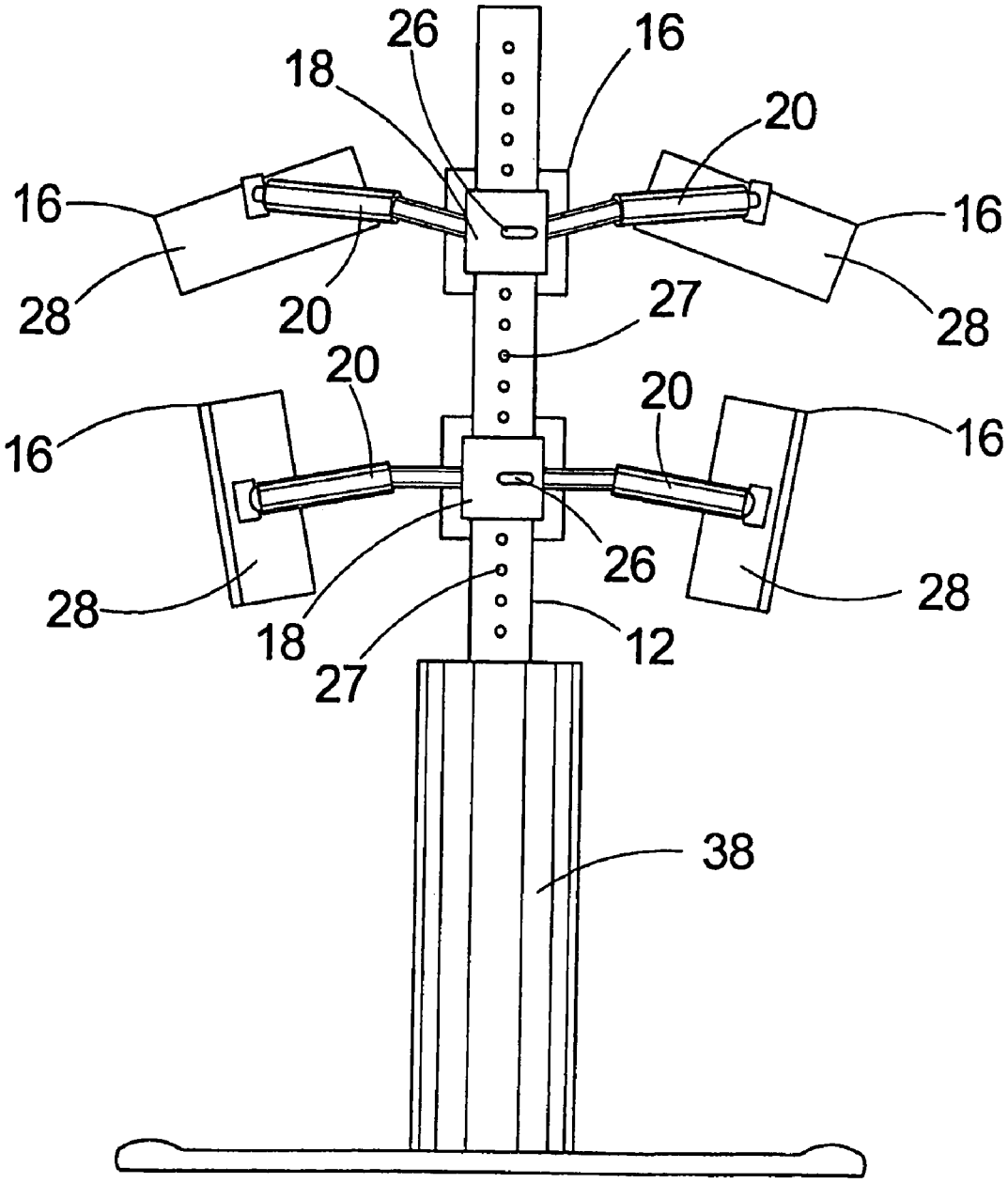
FIG. 3 is a rear view of the present invention.

With reference now to the drawings, and in particular to FIGS. 1 through 11 thereof, a new vertical training apparatus embodying the principles and concepts of the present invention and generally designated by the reference numeral 10 will be described.

As best illustrated in FIGS. 1 through 11, the vertical training apparatus 10 generally comprises a stanchion member 12 being designed for being coupled to a support surface whereby the stanchion member 12 extends upwardly from the support surface. The stanchion member 12 may be collapsible or telescopic to allow the stanchion member 12 to require less space during storage or to allow the stanchion member 12 to be set at a variety of heights.

A plurality of target assemblies 14 are adjustably coupled to the stanchion member 12. Each of the target assemblies 14 is designed for being struck by the user to practice strikes. One of the target assemblies 14 is designed for representing an upper torso of an opponent to allow the user to practice strikes against the upper torso of the opponent, the other of the target assemblies 14 is designed for representing a lower torso of the opponent to allow the user to practice strikes against the lower torso of the opponent.

A plurality of strike targets 16 are coupled to each of the target assemblies 14. Each of the strike targets 16 is designed for being struck by the user whereby the strike targets 16 provide an area for the user to strike when the user is practicing strikes.

Each of the target assemblies 14 comprises a mounting member 18 and a plurality of arm members 20. Each of the arm members 20 is coupled to the mounting member 18 whereby the arm members 20 extend outwardly from the mounting member 18. The mounting member 18 is adjustably coupled to the stanchion member 12 to support the arm members 20 from the stanchion member 12. The arm members 20 may be coupled to the mounting member 18 in a variety of way to provide a variety of desired positions of the arm members 20 such as the arm members 20 being fixedly mounted to the mounting member 18 to inhibit movement of the arm members 20 with respect to the mounting member 20.

The mounting member 18 of each of the target assemblies 14 comprises a perimeter wall 22 defining a receiving bore 24 extending through the mounting member 18. The receiving bore 24 slidably receives the stanchion member 12 whereby the mounting member 18 is selectively slid along the stanchion member 12 to permit adjusting of the associated one of the target assemblies 14 to a desired location on the stanchion member 12.

Each of the target assemblies 14 comprises a locking member 26. The locking member 26 is operationally coupled to the mounting member 18 of the associated one of the target assemblies 14. The locking member 26 is selectively extended through the mounting member 18 and into one of a plurality of mounting apertures 27 of the stanchion member 12 to selectively mount the associated one of the target assemblies 14 at the desired location on the stanchion member 12 when the locking member 26 is actuated by the user.

The strike targets 16 comprise a plurality of side targets 28. Each the side targets 28 is coupled to one of the arm members 20 of the associated one of the target assemblies 14. The side targets 28 are designed for being struck by strikes being directed towards an associated side of the user.

The strike targets 16 comprise a plurality of center targets 30. Each of the center targets 30 is coupled to the mounting member 18 of the associated one of the target assemblies 14. The center targets 30 are designed for being struck by strikes being directed in front of the user.

Each of the strike targets 16 comprises a pad portion 32 and an absorbing assembly 34. The absorbing assembly 34 is coupled to the associated one of the arm assemblies. The pad portion 32 is coupled to the absorbing portion opposite the associated one of the arm assemblies. The pad portion 32 is designed for being struck by the user whereby the absorbing assembly 34 is for absorbing the force of the strike on the pad portion 32 when the pad portion 32 is struck by the user. The pad portion 32 may be covered by leather to allow the inhibit the pad portion 32 from wearing with continued use.

The absorbing assembly 34 of each of the strike targets 16 comprises at least one shock absorbing member 36. The shock absorbing member 36 is designed for absorbing the force applied to the pad portion 32 when the pad portion 32 is struck by the user. The shock absorbing member 36 may comprise a spring. The spring is compressed to absorb the force applied to the pad portion 32 when the pad portion 32 is struck by the user.

A lower target member 38 is coupled to the stanchion member 12 whereby the lower target member 38 is positioned below the target assemblies 14. The lower target member 38 is designed for representing a lower portion of the opponent to allow the user to practice strikes to the lower portion of the opponent, particularly leg strikes. The lower target member 38 may comprise a plurality of layers of foam to absorb blows from leg strikes.

Figure 11:
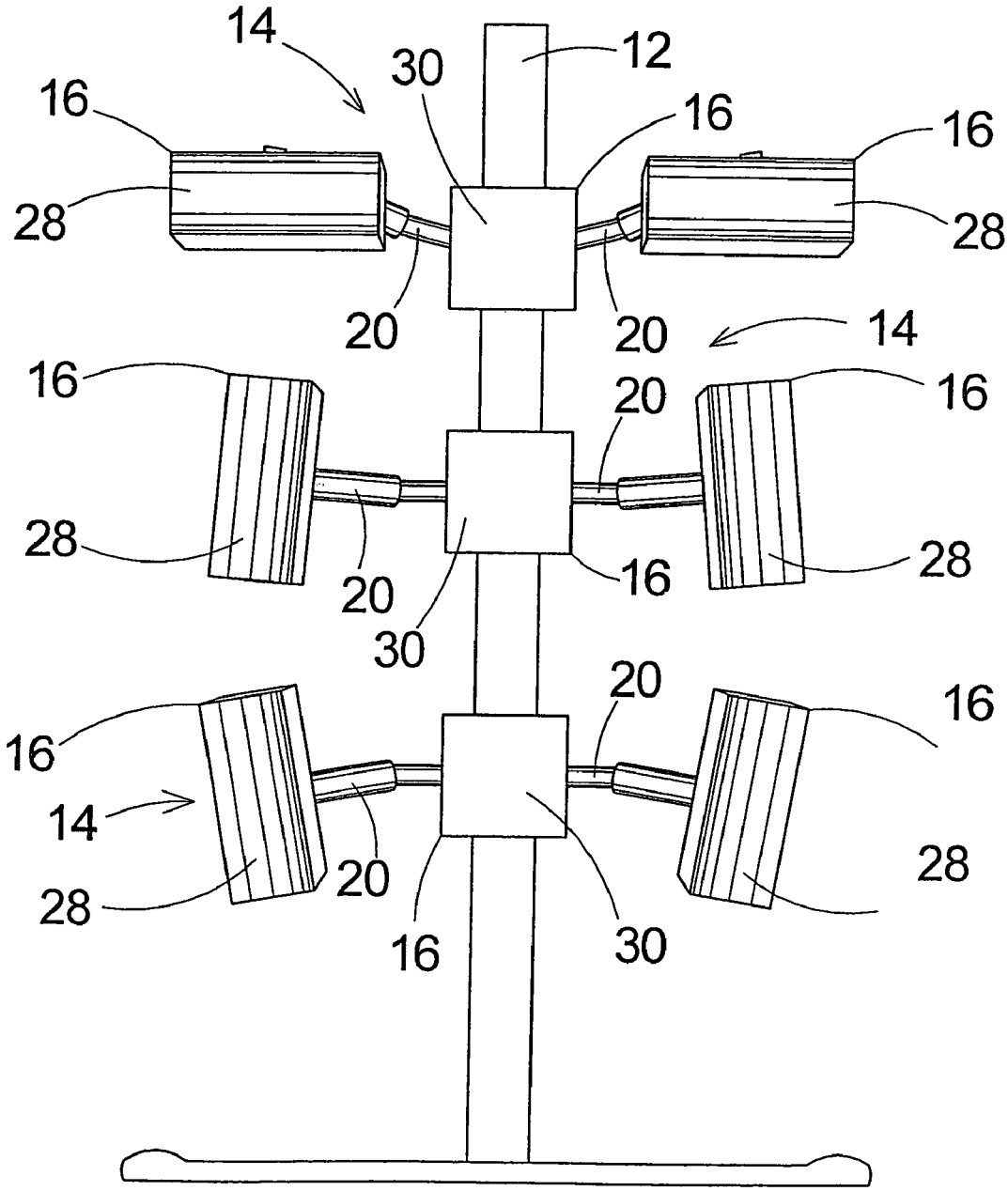
FIG. 11 is a front view of an alternate embodiment of the present invention.
Figure 12:
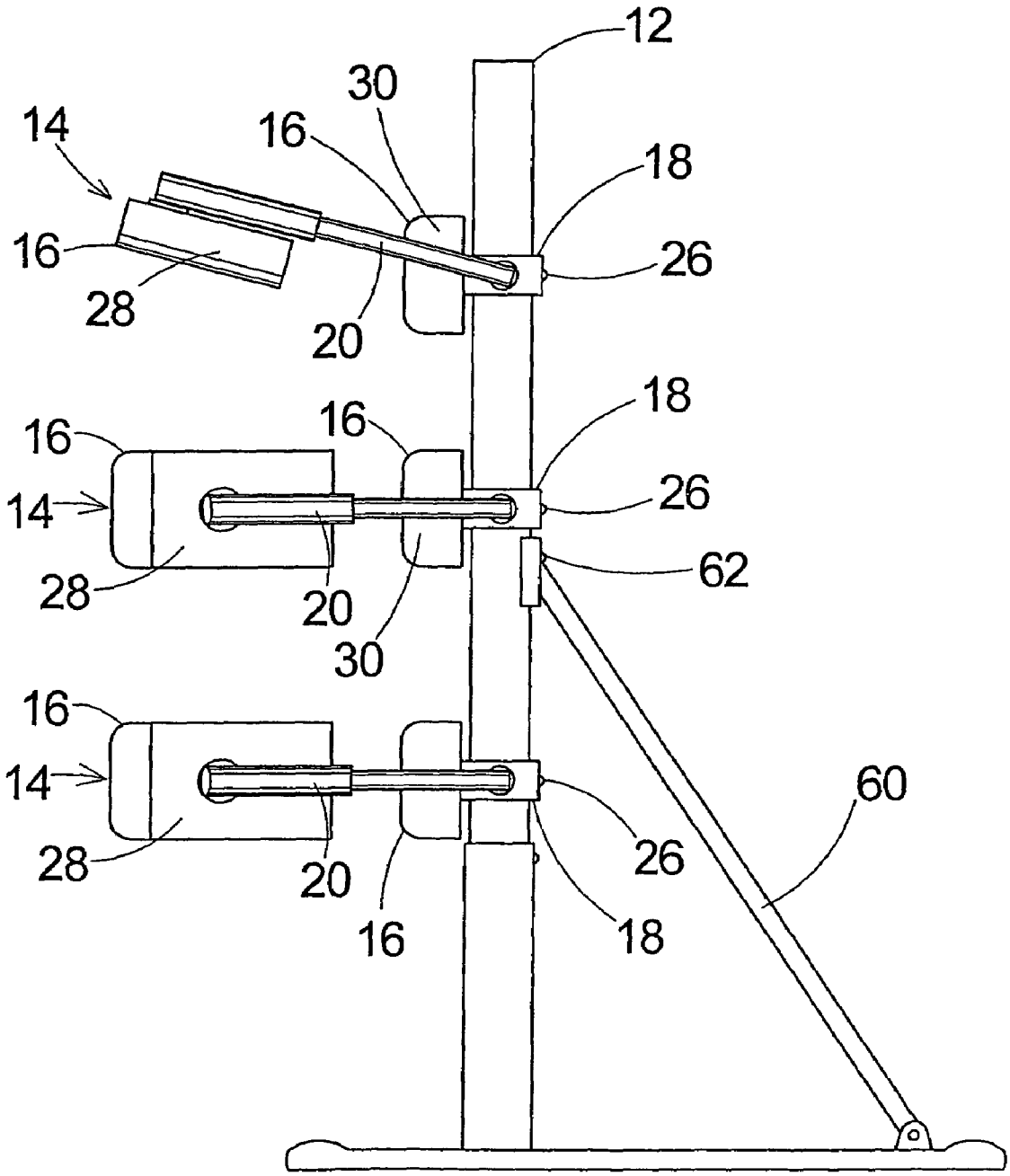
FIG. 12 is a side of the embodiment of the present invention shown in FIG. 11.

In an embodiment, as shown in FIGS. 11 and 12, the lower target member 38 may be replaced by a third set of target assemblies 14 to represent the lower portion of the opponent. The third set of target assemblies 14 allows the user to practice leg strikes at the strike targets 16 of the associated one of the target assemblies 14.

Figure 4:
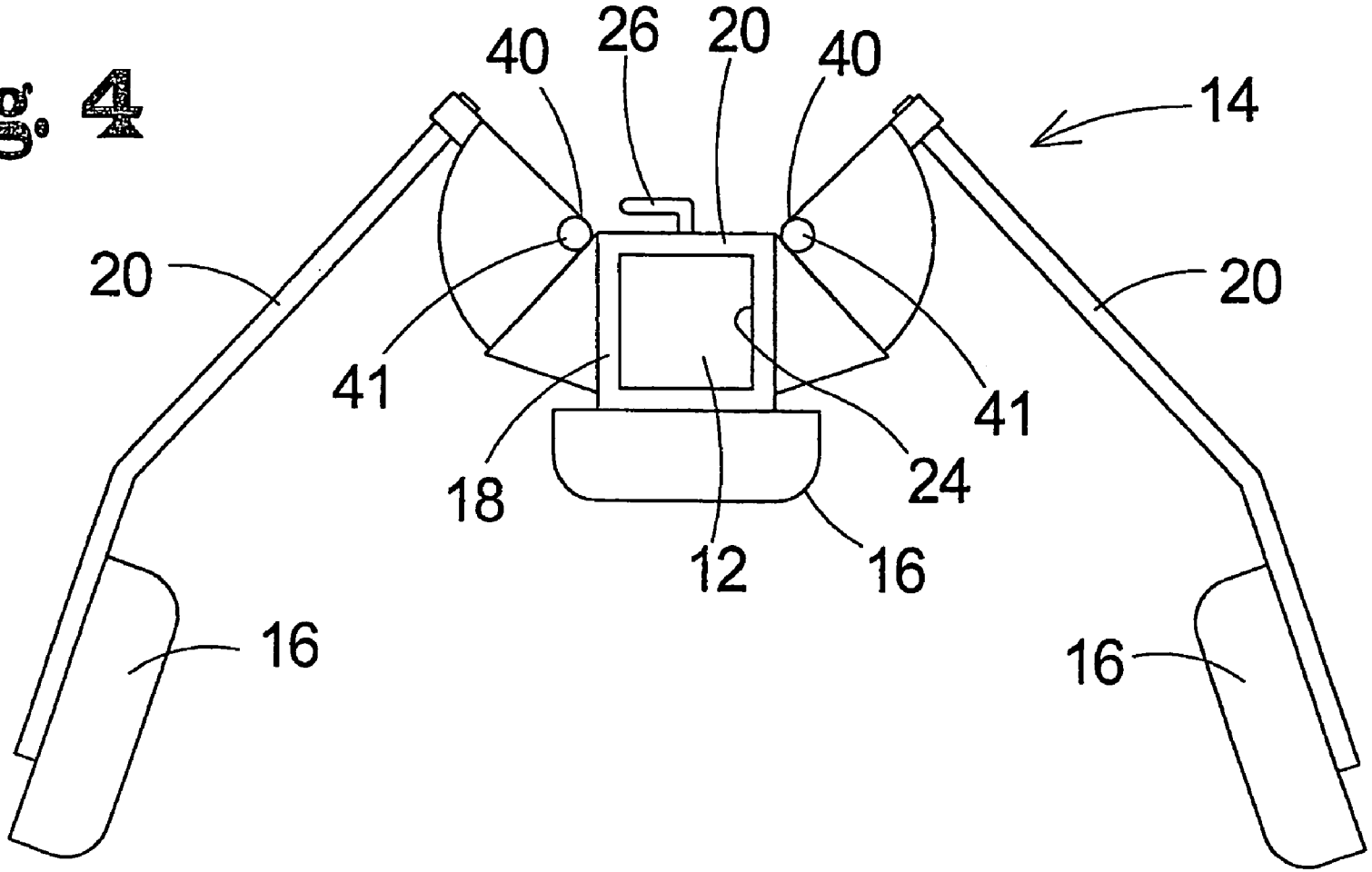
FIG. 4 is a top view of an alternate embodiment of the present invention.
Figure 5:
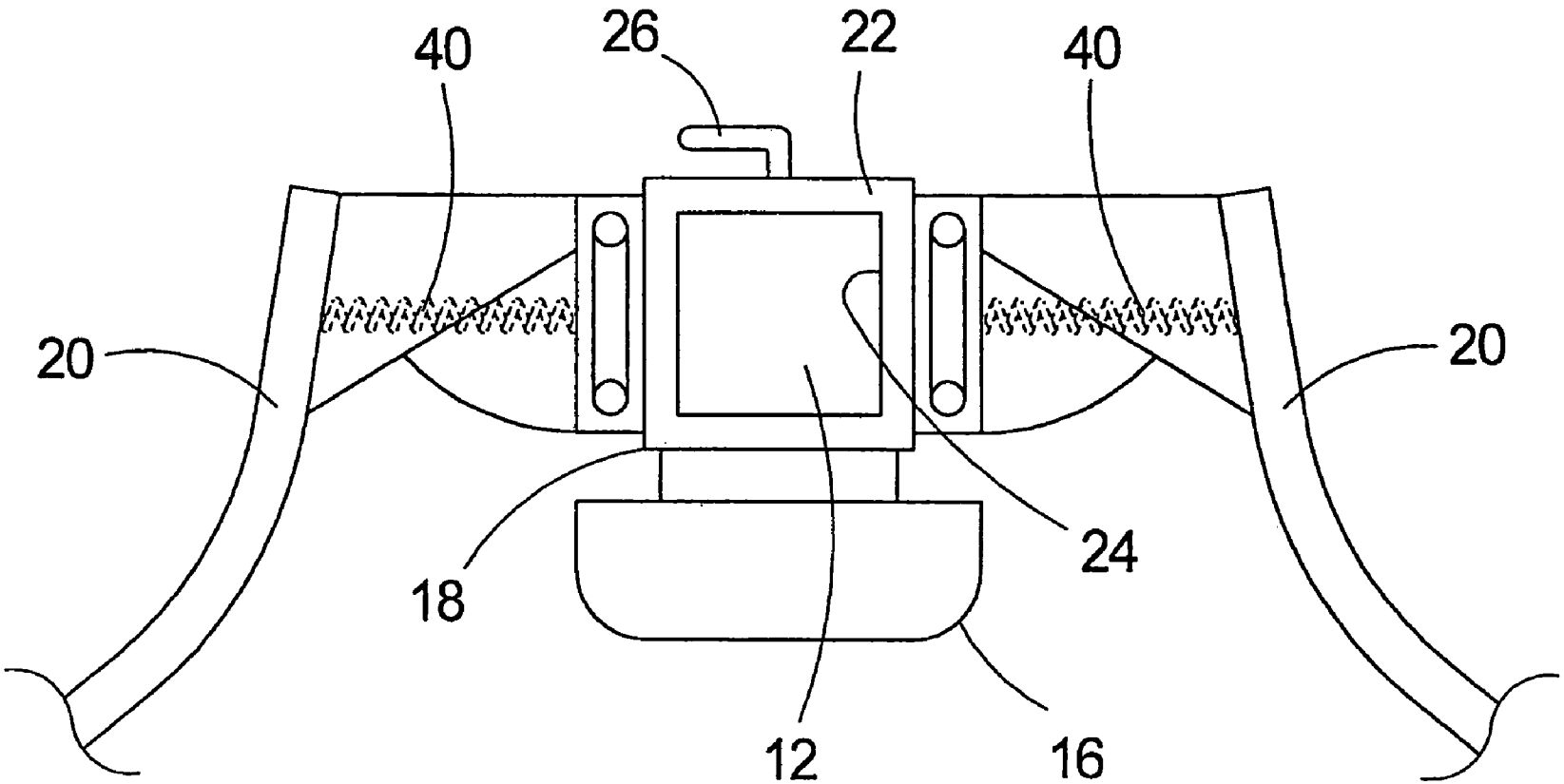
FIG. 5 is a top view of an alternate embodiment of the present invention.

Each of the target assemblies 14 may also comprise a plurality of biasing members 40. Each of the biasing members 40 is operationally coupled between one of the arm members 20 and the mounting member 18 of the associated one of the target assemblies 14. The biasing members 40 are for absorbing shock and returning the associated one of the arm members 20 to a ready position when the user strikes one of the arm members 20 of the target assemblies 14. As shown in FIG. 4, the biasing members 40 may comprise a spring hinges 41. Each of the spring hinges 41 being coupled between the mounting member 18 and one of the arm members 20 of the associated one of the target assemblies 14. As shown in FIG. 5, the biasing members 40 may comprise springs. The springs extend between mounting member 18 and one of the arm members 20 of the associated one of the target assemblies 14.

Figure 6:
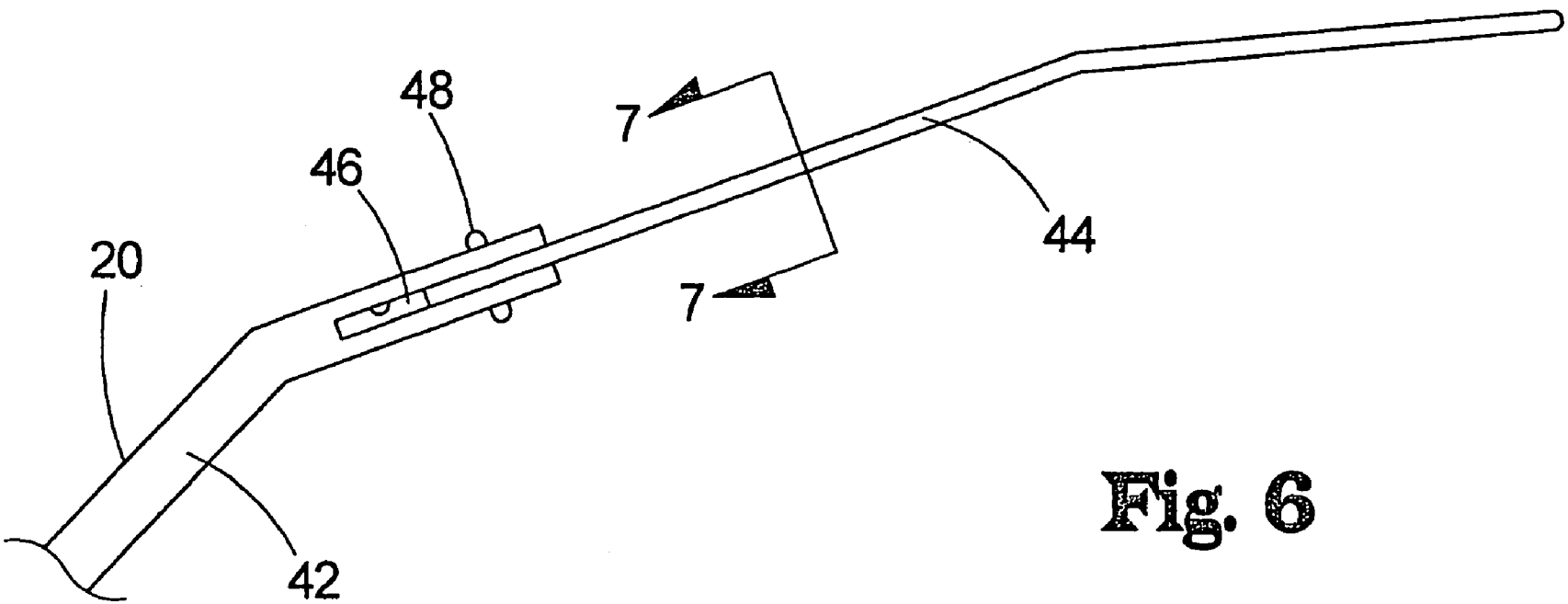
FIG. 6 is a top view of the arm members of the present invention.

In an embodiment, as shown in FIG. 6, each of the arm members 20 of each of the target assemblies 14 comprises a base portion 42 and an extension portion 44. The base portion 42 is coupled to the mounting member 18 of the associated one of the target assemblies 14. The extension portion 44 is operationally coupled to the base portion 42 opposite the mounting member 18 whereby a length of the extension portion 44 extending from the base portion 42 is selectively variable by the user. One of the strike targets 16 is coupled to the extension portion 44 of each of the arm members 20 of each of the target assemblies 14 to allow selective positioning of the strike targets 16 by the user.

Figure 7:
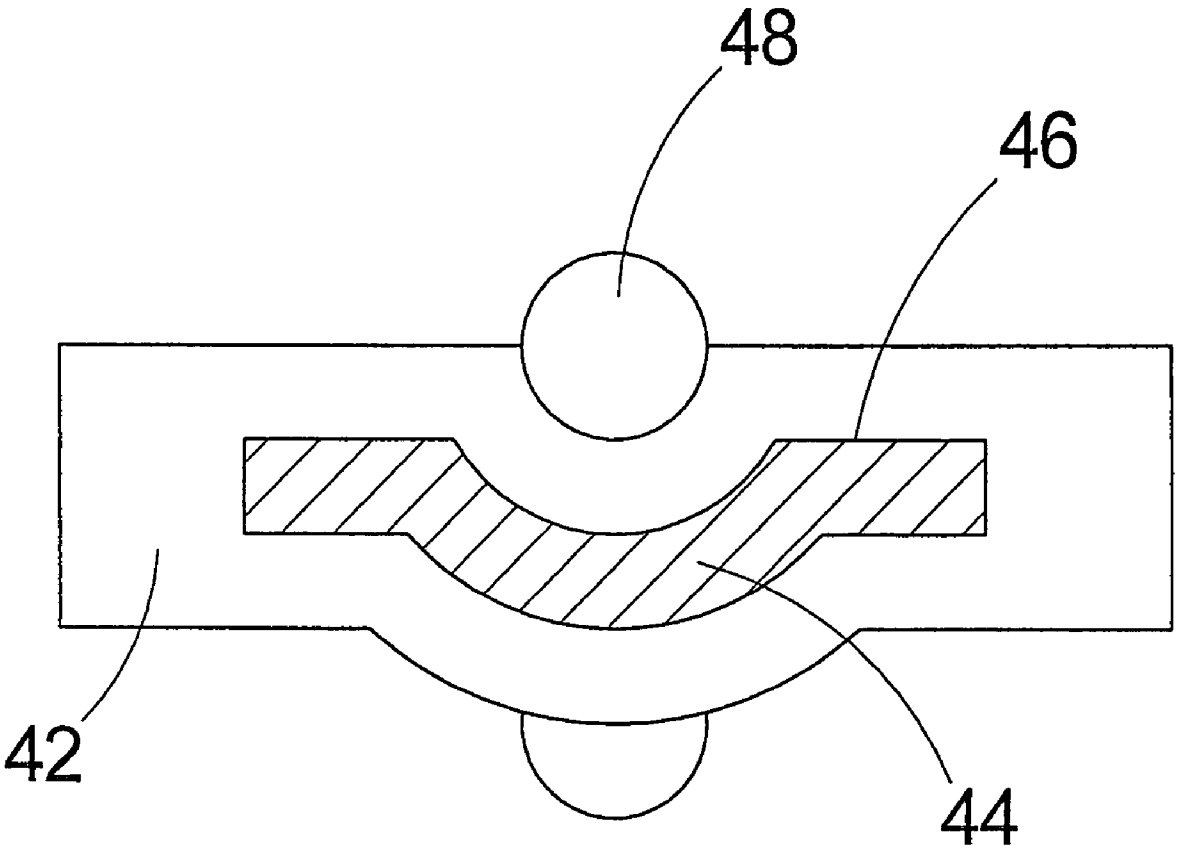
FIG. 7 is a cross-sectional view of one of the arm members of the present invention taken along line 7-7 of FIG. 6.
Figure 8:
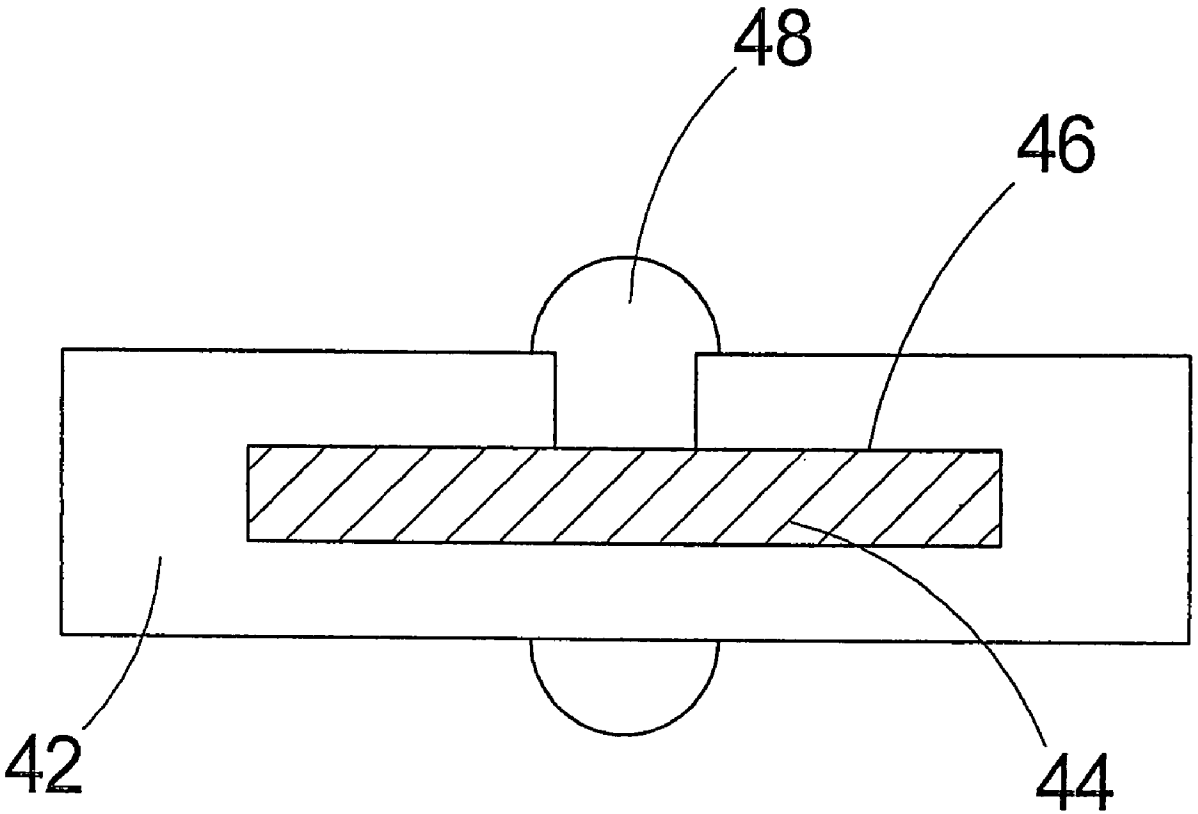
FIG. 8 is a cross-sectional view of an alternate embodiment of the one of the arm members the present invention as shown in FIG. 7.

The base portion 42 of the each of the arm members 20 comprises a sleeve bore 46 extending into the base portion 42. The extension portion 44 of the arm portions is selectively inserted into the sleeve bore 46 of the base portion 42 of the associated one of the arm members 20 to selectively couple the extension portion 44 to the base portion 42 of the associated one of the arm members 20. The sleeve bore 46 of the base portion 42 may comprise a variety of different configurations as shown in FIGS. 7 and 8.

Each of the arm members 20 comprises a pin member 48. The pin member 48 selectively extends through the base portion 42 and the extension portion 44. The pin member secures the extension portion 44 to the base portion 42 of the associated one of the arm members 20 when the pin member 48 is extending through the base portion 42 and the extension portion 44.

Figure 9:
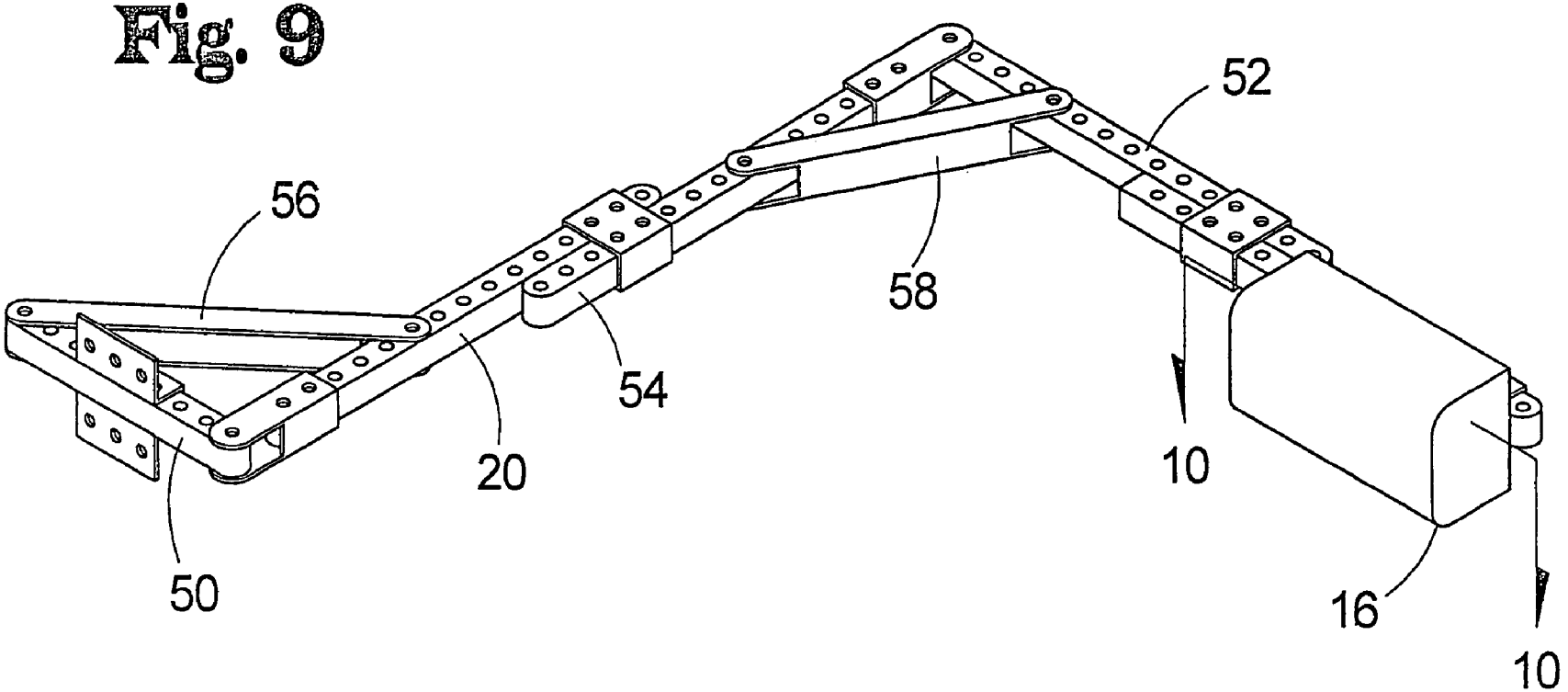
FIG. 9 is a perspective view of an alternate embodiment of the arm members of the present invention.
Figure 10:
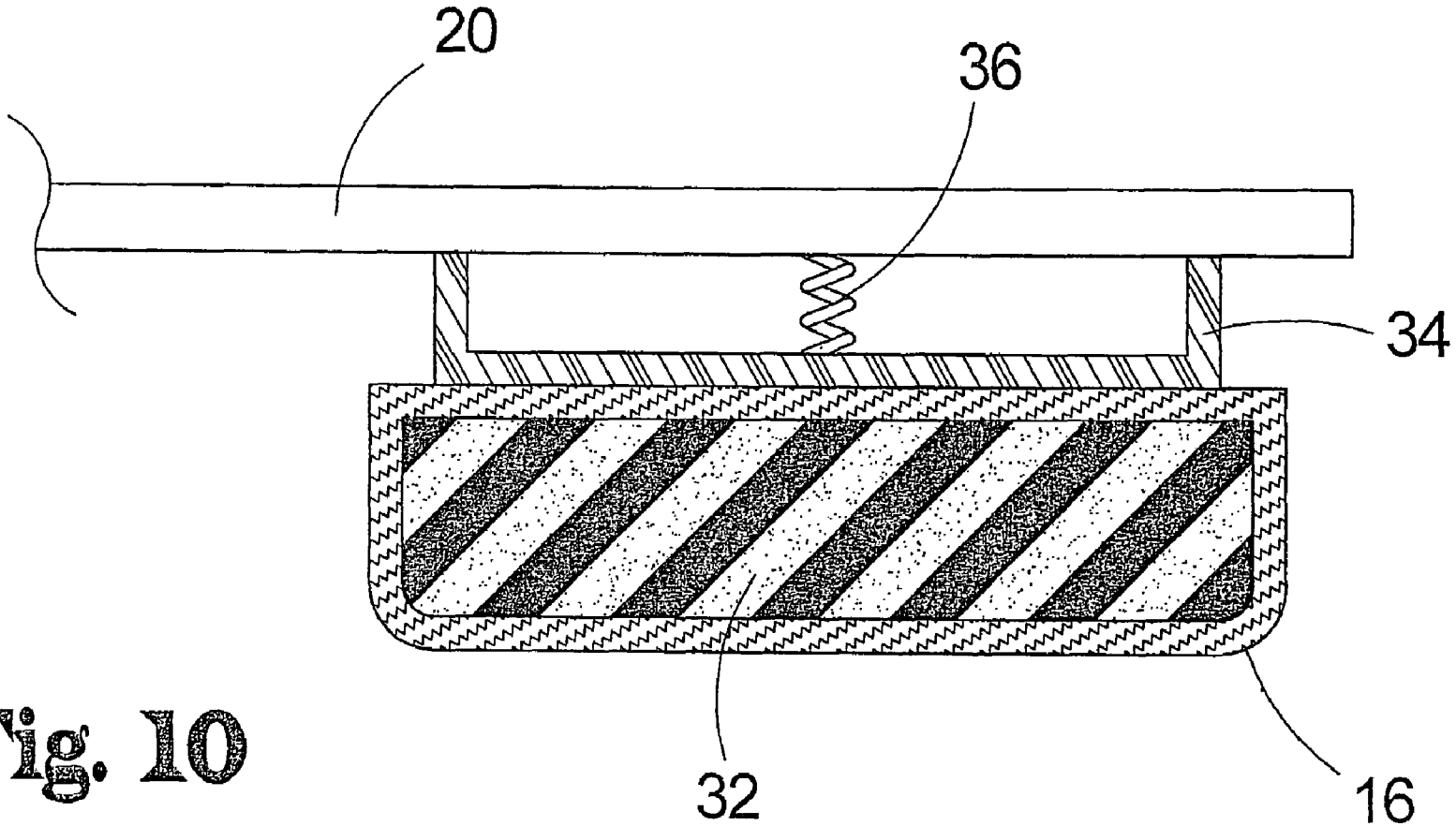
FIG. 10 is a cross-sectional view of one of the strike targets of the present invention taken along line 10-10 of FIG. 9.

In an embodiment, as shown in FIG. 9, each of the arm members 20 comprises a proximal portion 50, a distal portion 52 and a medial portion 54. The proximal portion 50 is coupled to the mounting member 18 of the associated one of the arm members 20. The medial portion 54 is pivotally coupled to the proximal portion 50 whereby the medial portion 54 is pivotally adjustable with respect to the proximal portion 50. The distal portion 52 is pivotally coupled to the medial portion 54 opposite the proximal portion 50 whereby the distal portion 52 is pivotally adjustable with respect to the medial portion 54. The distal portion 52 is coupled to one of the strike targets 16 whereby the distal portion 52 and the medial portion 54 are selectively pivoted to adjust the positioning of the associated one of the strike targets 16.

Each of the arm members 20 comprises a medial adjustment member 56. The medial adjustment member 56 is operationally coupled to the medial portion 54 and the proximal portion 50. The medial adjustment member 56 is for pivoting the medial portion 54 with respect to the proximal portion 50 and maintain positioning of the medial portion 54 when the medial adjustment member 56 is actuated by the user.

Each of the arm members 20 comprises a distal adjustment member 58. The distal adjustment member 58 is operationally coupled to the distal portion 52 and the medial portion 54. The distal adjustment member 58 is for pivoting the distal portion 52 with respect to the medial portion 54 and maintain positioning of the distal portion 52 when the distal adjustment member 58 is actuated by the user.

A support member 60 is selectively coupled to the stanchion member 12 whereby the support member 60 is designed for extending between the stanchion member 12 to the support surface. The support member 60 provides additional support to the stanchion member 12 when the target assemblies 14 are struck by a user. The support member 60 is selectively decoupled from the stanchion member 12 to permit the target assemblies 14 to be adjusted. An engagement member 62 is selectively extended through the support member 60 and into one of the mounting apertures 27 of the stanchion member 12 to selectively secure the support member 60 to the stanchion member 12.

In use, the user actuates the locking member 26 of each of the target assemblies 14 to allows the mounting member 18 of the associated one of the target assemblies 14 to be slid along the stanchion member 12 and position as desired by the user. The arm members 20 of each of the target assemblies 14 are then positioned as desired. The user then stands in front of the stanchion member 12 and uses the arms, hands, legs and feet to strike the strike targets 16 and the lower target member 38 to practice striking an opponent in a variety of places and a variety of combination of strikes.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vertical training apparatus for allowing a user to practice strikes using hands, arms, legs and feet of the user, the vertical training apparatus comprising:

an elongated stanchion member restable on a support surface such that a length of said stanchion member extends upwardly from the support surface; and at least one target assembly adjustably coupled to said stanchion member such that a position of said at least one target assembly along at least a portion of the length of said stanchion member is adjustable;

said at least one target assembly comprising a mounting member and a plurality of arm members, each of said arm members being coupled to said mounting member and extending outwardly from said mounting member to extend in generally opposite directions from said stanchion member;

a plurality of strike targets being coupled to said at least one target assembly, each of said strike targets having a strike surface for being struck by the user;

wherein said plurality of strike targets include a center target, said center target being coupled to said mounting member of said target assembly for being struck by strikes being directed in front of the user;

wherein said plurality of strike targets comprise at least one said target coupled to each of said arm members of said at least one target assembly toward an outer end of the respective said arm member for being struck by strikes being directed towards sides of the user;

wherein said plurality of strike targets are movable as a unit on said at least one target assembly along the portion of the length of said stanchion member for adjustment of a height of the plurality of strike targets above the support surface.

2. The vertical training apparatus as set forth in claim 1, wherein said mounting member of each of said target assemblies comprising a perimeter wall defining a receiving bore extending through said mounting member, said receiving bore slidably receiving said stanchion member such that said mounting member is selectively slidable along said stanchion member to permit adjusting of said at least one target assembly to a desired location on said stanchion member.

3. The vertical training apparatus as set forth in claim 2, wherein said at least one target assembly comprises a locking member operationally coupled to said mounting member of said at least one target assembly, said locking member being selectively extended through said mounting member and into one of a plurality of mounting apertures of said stanchion member to selectively mount said at least one target assembly at the desired location on said stanchion member when said locking member is actuated by the user.

4. The vertical training apparatus as set forth in claim 1, said at least one target assembly comprising a plurality of biasing members, each of said biasing members being operationally coupled between one of said arm members and said mounting member of said at least one target assembly, said biasing members being for absorbing shock and returning the associated one of said arm members to a ready position when the user strikes one of said arm members of said at least one target assembly.

5. The vertical training apparatus as set forth in claim 1, wherein each of said arm members of said at least one target assembly comprises a base portion and an extension portion, said base portion being coupled to said mounting member of said at least one target assembly, said extension portion being operationally coupled to said base portion opposite said mounting member such that a length of said extension portion extending from said base portion is selectively variable by the user, one of said strike targets being coupled to said extension portion of each of said arm members of said at least one target assembly to allow selective positioning of said strike targets by the user.

6. The vertical training apparatus as set forth in claim 5, further comprising:

said base portion of said each of said arm members comprising a sleeve bore extending into said base portion, said extension portion of said arm portions being selectively inserted into said sleeve bore of said base portion of the associated one of said arm members to selectively couple said extension portion to said base portion of the associated one of said arm members.

7. The vertical training apparatus as set forth in claim 5, further comprising:

each of said arm members comprising a pin member, said pin member selectively extending through said base portion and said extension portion, said pin member securing said extension portion to said base portion of the associated one of said arm members when said pin member is extending through said base portion and said extension portion.

8. The vertical training apparatus as set forth in claim 1, further comprising:

each of said arm members comprising a proximal portion, a distal portion and a medial portion, said proximal portion being coupled to said mounting member of the associated one of said arm members, said medial portion being pivotally coupled to said proximal portion such that said medial portion is pivotally adjustable with respect to said proximal portion, said distal portion being pivotally coupled to said medial portion opposite said proximal portion such that said distal portion is pivotally adjustable with respect to said medial portion, said distal portion being coupled to one of said strike targets such that said distal portion and said medial portion are selectively pivoted to adjust the positioning of the associated one of said strike targets.

9. The vertical training apparatus as set forth in claim 8, further comprising:

each of said arm members comprising a medial adjustment member, said medial adjustment member being operationally coupled to said medial portion and said proximal portion, said medial adjustment member being for pivoting said medial portion with respect to said proximal portion and maintain positioning of said medial portion when said medial adjustment member is actuated by the user.

10. The vertical training apparatus as set forth in claim 8, further comprising:

each of said arm members comprising a distal adjustment member, said distal adjustment member being operationally coupled to said distal portion and said medial portion, said distal adjustment member being for pivoting said distal portion with respect to said medial portion and maintain positioning of said distal portion when said distal adjustment member is actuated by the user.

11. A vertical training apparatus for allowing a user to practice strikes using hands, arms, legs and feet of the user, the vertical training apparatus comprising:

a stanchion member being adapted for being coupled to a support surface such that said stanchion member extends upwardly from the support surface; and a plurality of target assemblies being adjustably coupled to said stanchion member, each of said target assemblies being adapted for being struck by the user to practice strikes, one of said target assemblies being adapted for representing an upper torso of an opponent to allow the user to practice strikes against the upper torso of the opponent, the other of said target assemblies being adapted for representing a lower torso of the opponent to allow the user to practice strikes against the lower torso of the opponent;

a plurality of strike targets being coupled to each of said target assemblies, each of said strike targets being adapted for being struck by the user such that said strike targets provide an area for the user to strike when the user is practicing strikes;

each of said strike targets comprising a pad portion and an absorbing assembly, said absorbing assembly being coupled to the associated one of said arm assemblies, said pad portion being coupled to said absorbing portion opposite the associated one of said arm assemblies, said pad portion being adapted for being struck by the user that said absorbing assembly is for absorbing the force of the strike on said pad portion when said pad portion is struck by the user.

12. The vertical training apparatus as set forth in claim 11, further comprising:

said shock absorbing member comprising a spring, said spring being compressed to absorb the force applied to said pad portion when said pad portion is struck by the user.

13. The vertical training apparatus as set forth in claim 1, further comprising:

a lower target member being coupled to said stanchion member such that said lower target member is positioned below said target assemblies, said lower target member being adapted for representing a lower portion of the opponent to allow the user to practice strikes to the lower portion of the opponent.

14. The vertical training apparatus as set forth in claim 1, further comprising:

a support member being selectively coupled to said stanchion member such that said support member is adapted for extending between said stanchion member to said support surface, said support member providing additional support to said stanchion member when said target assemblies are struck by a user, said support member being selectively decoupled from said stanchion member to permit said at least one target assembly to be adjusted.

15. The vertical training apparatus as set forth in claim 1, wherein the at least one side target comprises a pair of said side targets with said pair of said targets being positioned on opposite lateral sides of said stanchion member.

16. The vertical training apparatus as set forth in claim 15, wherein each of said strike targets has a strike surface, and the strike surface of said center target of said at least one target assembly being positioned with respect to said stanchion member such that the strike surface of said center target is positioned between a user and said stanchion member, and the strike surface of each of said side targets being positioned on laterally opposite sides of the strike surface of said center target.

17. The vertical training apparatus as set forth in claim 1, wherein said at least one target assembly includes a plurality of target assemblies, a first one of said target assemblies representing an upper torso of an opponent being positioned above a second one of said target assemblies representing a lower torso of the opponent.

18. A vertical training apparatus for allowing a user to practice strikes using hands, arms, legs and feet of the user, the vertical training apparatus comprising:

a stanchion member being adapted for being coupled to a support surface such that said stanchion member extends upwardly from the support surface; and a plurality of target assemblies being adjustably coupled to said stanchion member, each of said target assemblies being adapted for being struck by the user to practice strikes, one of said target assemblies being adapted for representing an upper torso of an opponent to allow the user to practice strikes against the upper torso of the opponent, the other of said target assemblies being adapted for representing a lower torso of the opponent to allow the user to practice strikes against the lower torso of the opponent;

a plurality of strike targets being coupled to each of said target assemblies, each of said strike targets being adapted for being struck by the user such that said strike targets provide an area for the user to strike when the user is practicing strikes;

each of said target assemblies comprising a mounting member and a plurality of arm members, each of said arm members being coupled to said mounting member such that said arm members extend outwardly from said mounting member, said mounting member being adjustably coupled to said stanchion member to support said arm members from said stanchion member;

said strike targets comprising a plurality of center targets, each of said center targets being coupled to said mounting member of the associated one of said target assemblies, said center targets being adapted for being struck by strikes being directed in front of the user;

each of said target assemblies comprising a plurality of biasing members, each of said biasing members being operationally coupled between one of said arm members and said mounting members of the associated one of said target assemblies, said biasing members being for absorbing shock and returning the associated one of said arm members to a ready position when the user strikes one of said arm members of said target assemblies.

* * * * *